US008134302B2

(12) United States Patent
Yang et al.

(10) Patent No.: US 8,134,302 B2
(45) Date of Patent: Mar. 13, 2012

(54) OFFLINE LED DRIVING CIRCUITS

(75) Inventors: Ta-Yung Yang, Milpitas, CA (US); Chien-Yuan Lin, Taipei County (TW); Chien-Tung Lan, Taipei (TW)

(73) Assignee: System General Corporation, Sindian, Taipei County (TW)

( * ) Notice: Subject to any disclaimer, the term of this patent is extended or adjusted under 35 U.S.C. 154(b) by 226 days.

(21) Appl. No.: 12/758,129

(22) Filed: Apr. 12, 2010

(65) Prior Publication Data

US 2011/0062876 A1 Mar. 17, 2011

Related U.S. Application Data

(60) Provisional application No. 61/276,675, filed on Sep. 14, 2009.

(51) Int. Cl.
*H05B 37/02* (2006.01)
*H05B 39/00* (2006.01)

(52) U.S. Cl. ..... 315/219; 315/306

(58) Field of Classification Search ..... 315/291, 315/307, 308, 224, 219, 276, 282, 306
See application file for complete search history.

(56) References Cited

U.S. PATENT DOCUMENTS 7,414,865 B2 * 8/2008 Yang ..... 363/21.16
7,778,051 B2 * 8/2010 Yang ..... 363/21.18
8,018,741 B2 * 9/2011 Huynh et al. ..... 363/21.01

* cited by examiner

*Primary Examiner* — Douglas W Owens
*Assistant Examiner* — Minh D A
(74) *Attorney, Agent, or Firm* — Thomas|Kayden

(57) ABSTRACT

An offline LED driving circuit includes a controller, a shunt regulator, an opto-coupler, and a dimming circuit. The controller generates a switching signal to switch a transformer for providing an output voltage and an output current. The shunt regulator is coupled to an output terminal of the LED driving circuit for providing a feedback signal to the controller via the opto-coupler. The dimming circuit coupled to the shunt regulator modulates the feedback signal at a first feedback level and a second feedback level in response to a dimming signal. The output voltage is respectively regulated at a first output level and a second output level in response to the first feedback level and the second feedback level of the feedback signal. The duty cycle of the switching signal will be varied in a soft-start manner when the feedback signal changes from the second feedback level to the first feedback level.

9 Claims, 6 Drawing Sheets

OFFLINE LED DRIVING CIRCUITS

CROSS REFERENCE TO RELATED APPLICATIONS

The present application claims the benefit of U.S. provisional application entitled "An Offline LED Drive Circuit with Dimming Control", Ser. No. 61/276,675, filed Sep. 14, 2009.

BACKGROUND OF THE INVENTION

1. Field of the Invention

The present invention relates to driving circuits, more particularly, the present invention relates to LED driving circuits.

2. Description of the Related Art

LED (Light Emitting Diode) technology is recently replacing traditional incandescent and fluorescent illuminating devices as lighting sources in many applications, such as automobiles and home appliances, because of their long lifespan, high optic efficiency, low profile, etc.

Traditional arts of LED dimming control are usually achieved by adjusting the forward current flowing through the LED. Taking a white-light LED for instance, the color temperature of it will become lower when the forward current flowing through it becomes smaller than its regular forward current. This color temperature variance is not desired by the industry. Therefore, there is a need to provide a LED dimming control with stable color temperature performance.

BRIEF SUMMARY OF THE INVENTION

An offline LED driving circuit to drive LEDs comprises a controller, a shunt regulator, an opto-coupler, and a dimming circuit. The controller generates a switching signal to switch a transformer for providing an output voltage and an output current at an output terminal of the offline LED driving circuit. The shunt regulator is coupled to the output terminal of the LED driving circuit for providing a feedback signal to the controller via the opto-coupler. The dimming circuit is coupled to the shunt regulator to modulate the feedback signal. The dimming circuit respectively modulates the feedback signal at a first feedback level and a second feedback level in response to a dimming signal. A duty cycle of the switching signal is varied in response to the feedback signal. The output voltage is respectively regulated at a first output level and a second output level in response to the first feedback level and the second feedback level of the feedback signal. The first feedback level is higher than the second feedback level. The controller comprises a soft-start circuit and a latch circuit. The soft-start circuit varies the duty cycle of the switching signal in response to the feedback signal. The duty cycle of the switching signal will be varied in a soft-start manner when the feedback signal changes from the second feedback level to the first feedback level. The latch circuit latches an output state of the latch circuit when the feedback signal changes from the first feedback level to the second feedback level.

The output voltage is regulated between the first output level and the second output level in response to the dimming signal. The output current is alternately regulated between zero and a constant current level in response to the dimming signal. The first output level of the output voltage is determined to be higher than a summed forward voltage of series connected LEDs driven by the offline LED driving circuit. The second output level of the output voltage is determined to be lower than a summed forward voltage of series connected LEDs driven by the offline LED driving circuit.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
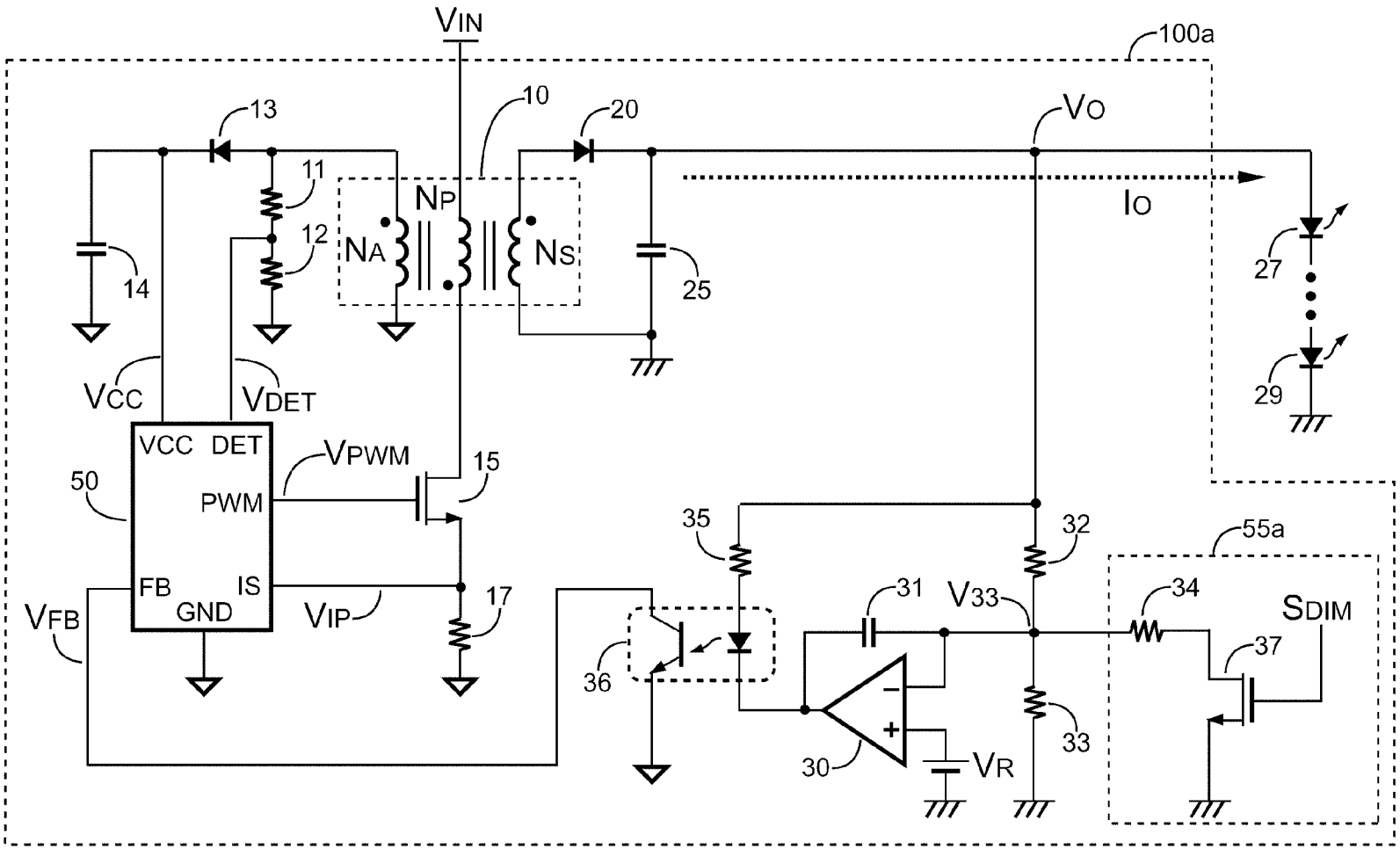
FIG. 1 shows an embodiment of an offline LED driving circuit according to the present invention.

The present invention provides an offline LED (Light Emitting Diode) driving circuit with dimming control. FIG. 1 shows an embodiment of the offline LED driving circuit 100*a* according to the present invention. The offline LED driving circuit 100*a* comprises a primary-side regulator, a feedback circuit, and a dimming circuit 55*a*. The primary-side regulator comprises a controller 50, a transformer 10, a transistor 15, rectifiers 13, 20, capacitors 14, 25, and resistors 11, 12, and 17. The feedback circuit comprises a shunt regulator, an opto-coupler 36, and a resistor 35. The offline LED driving circuit 100*a* is utilized to drive LEDs 27~29 which are connected to each other in series.

The controller 50 generates a switching signal $V_{PWM}$ to switch the transformer 10 via the transistor 15. The controller 50 controls the primary-side regulator to provide an output voltage $V_O$ and a constant current $I_O$ at an output terminal of the offline LED driving circuit 100*a*. More detailed operation description of the primary-side regulator can be found in the U.S. Pat. No. 6,977,824 titled "Control Circuit for Controlling Output Current at the Primary Side of a Power Converter". An error amplifier 30, a reference voltage $V_R$, a capacitor 31, and a voltage divider form the shunt regulator. The capacitor 31 is connected from a negative terminal and an output terminal of the error amplifier 30 for voltage-feedback-loop compensation. An input terminal of the shunt regulator is coupled to the output terminal of the offline LED driving circuit 100*a* via the voltage divider formed by a resistor 32 and a resistor 33. The voltage divider is connected between the output terminal of the offline LED driving circuit 100*a* and a secondary ground reference. An output terminal of the shunt regulator is coupled to a feedback terminal FB of the controller 50 via the opto-coupler 36. A feedback signal $V_{FB}$ is obtained at the feedback terminal FB of the controller 50. The duty cycle of the switching signal $V_{PWM}$ is varied in response to the feedback signal $V_{FB}$. The dimming circuit 55*a* comprises a resistor 34 and a transistor 37. The resistor 34 is connected between a drain of the transistor 37 and a joint of the voltage divider. A source of the transistor 37 is connected to the secondary ground reference. A dimming signal $S_{DIM}$ controls a gate of the transistor 37. The dimming circuit 55*a* is coupled to the shunt regulator to modulate the feedback signal $V_{FB}$. A voltage $V_{33}$ across the resistor 33 is compared with the reference voltage $V_R$ to determine a level at the output terminal of the error amplifier 30.

Figure 2:
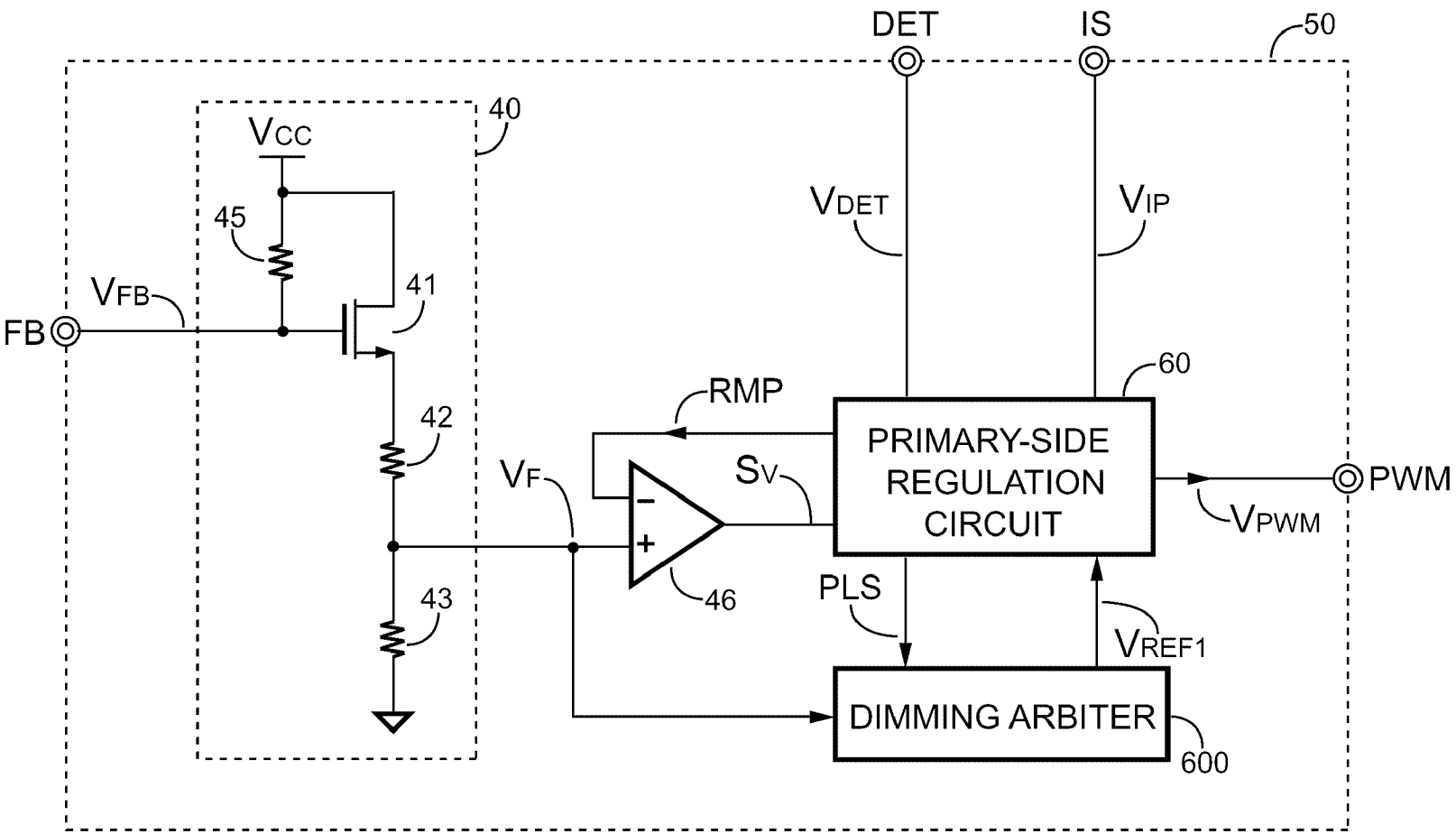
FIG. 2 shows an embodiment of a controller of the offline LED driving circuit according to the present invention.

FIG. 2 shows an embodiment of the controller 50 according to the present invention. The controller 50 comprises an attenuation circuit 40, a comparator 46, a primary-side-regulation circuit 60, and a dimming arbiter 600. The attenuation circuit 40 comprises a transistor 41 and resistors 42, 43, and 45. The resistor 45 is connected between a voltage source $V_{CC}$ and a gate of the transistor 41. The gate of the transistor 41 is connected to the feedback terminal FB of the controller 50. A drain of the transistor 41 is connected to the voltage source $V_{CC}$. Resistors 42 and 43 are connected in series between a source of the transistor 41 and a primary ground reference. The attenuation circuit 40 generates a control signal $V_F$ in response to the feedback signal $V_{FB}$. The control signal $V_F$ can be expressed by following equation:

$$V_F = \frac{R_{43}}{R_{42} + R_{43}} \times (V_{FB} - V_{TH}) \tag{1}$$

where $V_{TH}$ is the threshold voltage of the transistor 41.

The primary-side regulation circuit 60 is coupled to receive a detection signal $V_{DET}$, a current-sense signal $V_{IP}$, a voltage-loop signal $S_V$, and a reference voltage $V_{REF1}$ for generating the switching signal $V_{PWM}$. The primary-side regulation circuit 60 further generates a pulse signal PLS and a ramp signal RMP. The control signal $V_F$ is supplied to the comparator 46 to be compared with the ramp signal RMP for generating the voltage-loop signal $S_V$. The control signal $V_F$ and the pulse signal PLS are supplied to the dimming arbiter 600 for determining the reference voltage $V_{REF1}$ to achieve soft-start operation of the output current $I_O$.

Figure 3:
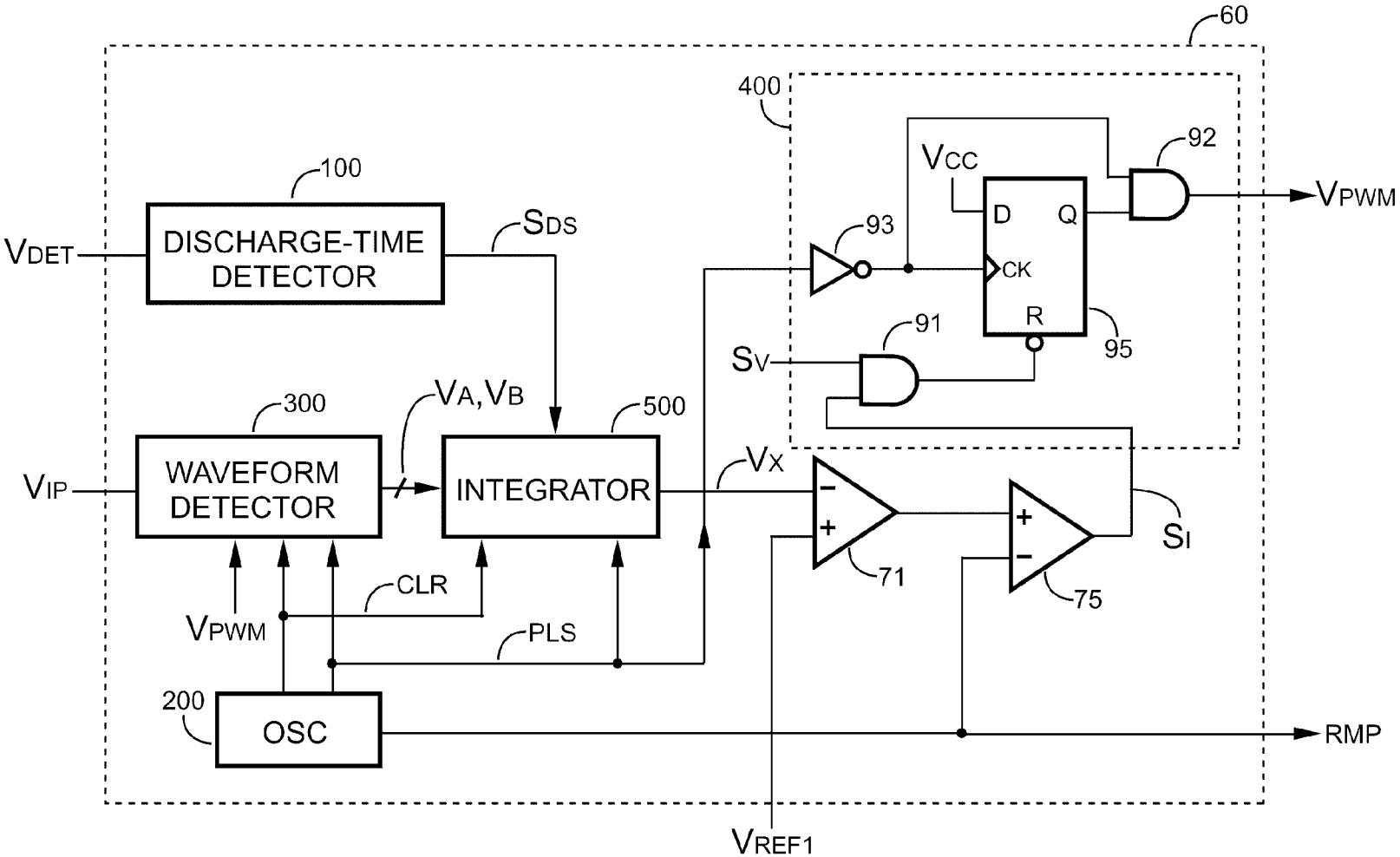
FIG. 3 shows an embodiment of a primary-side-regulation circuit of the controller according to the present invention.

FIG. 3 shows an embodiment of the primary-side-regulation circuit 60 according to the present invention. Detailed theory and circuit operation of the primary-side-regulation circuit 60 can also be found in the U.S. Pat. No. 6,977,824 titled "Control Circuit for Controlling Output Current at the Primary Side of a Power Converter" and will be omitted herein.

Figure 4:
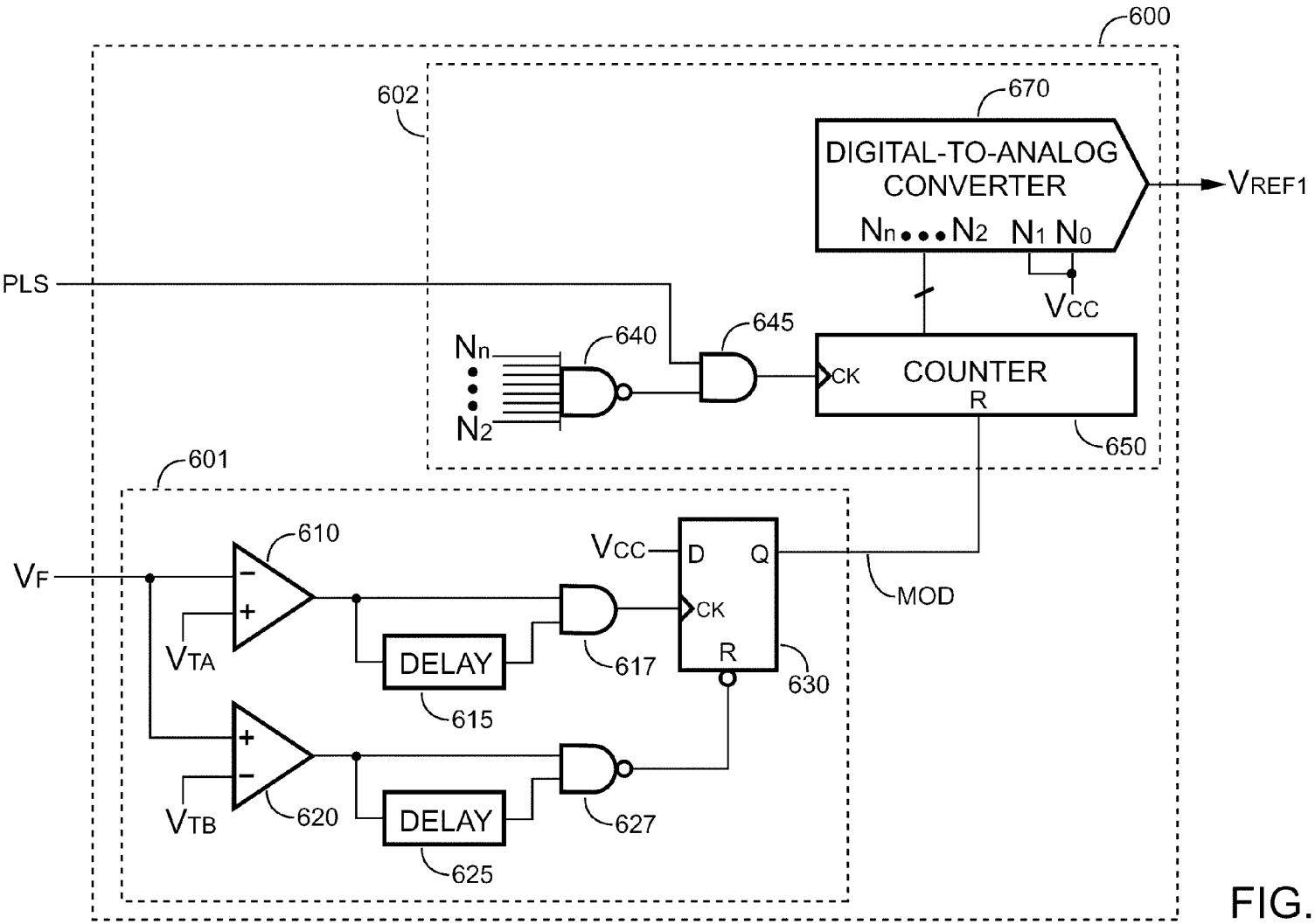
FIG. 4 shows an embodiment of a dimming arbiter of the controller according to the present invention.

FIG. 4 shows an embodiment of the dimming arbiter 600 according to the present invention. The dimming arbiter 600 comprises a latch circuit 601 and a soft-start circuit 602. The latch circuit 601 comprises comparators 610 and 620, delay circuits 615 and 625, an AND gate 617, a NAND gate 627, and a flip-flop 630. A negative terminal of the comparator 610 and a positive terminal of the comparator 620 are supplied with the control signal $V_F$. A positive terminal of the comparator 610 and a negative terminal of the comparator 620 are respectively supplied with a threshold $V_{TA}$ and a threshold $V_{TB}$. A first input terminal of the AND gate 617 is connected to an output terminal of the comparator 610. A second input terminal of the AND gate 617 is connected to the output terminal of the comparator 610 via the delay circuit 615. A first input terminal of the NAND gate 627 is connected to an output terminal of the comparator 620. A second input terminal of the NAND gate 627 is connected to the output terminal of the comparator 620 via the delay circuit 625. An output terminal of the AND gate 617 generates a set signal for setting the flip-flop 630. An output terminal of the NAND gate 627 generates a reset signal for resetting the flip-flop 630. An output terminal of the flip-flop 630 generates a soft-start signal MOD. The latch circuit 601 generates the soft-start signal MOD in response to the control signal $V_F$. When the control signal $V_F$ is lower than the threshold $V_{TA}$, the set signal will be generated to set the flip-flip 630. Once the control signal $V_F$ is higher than the threshold $V_{TB}$, the reset signal will be generated to reset the flip-flip 630. The delay circuit 615 and the AND gate 617 provide de-bounce operation for generating the set signal. The delay circuit 625 and the NAND gate 627 provide de-bounce operation for generating the reset signal. Therefore, the output state of the latch circuit 601 will be latched when the feedback signal $V_{FB}$ changes from a first feedback level to a second feedback level.

The soft-start circuit 602 comprises a NAND gate 640, an AND gate 645, a counter 650, and a digital-to-analog converter 670. The soft-start signal MOD is coupled to reset the counter 650 when the soft-start signal MOD is logic-high. The pulse signal PLS is supplied to a first input terminal of the AND gate 645. An output terminal of the AND gate 645 is utilized to clock the counter 650. The counter 650 generates digital signals $N_n \ldots N_2$ in response to the pulse signal PLS. The digital-to-analog converter 670 has digital input terminals for receiving the digital signals $N_n \ldots N_2$. The digital-to-analog converter 670 further has digital input terminals receiving digital signals $N_1$ and $N_0$ which are connected to the voltage source $V_{CC}$ (logic-high). The digital signal $N_n$ is the most significant bit and the digital signal $N_0$ is the least significant bit. The value of the reference voltage $V_{REF1}$ generated by the digital-to-analog converter 670 is converted from digital signals $N_n \ldots N_0$. The NAND gate 640 has input terminals supplied with digital signals $N_n \ldots N_2$. An output terminal of the NAND gate 640 is connected to a second input terminal of the AND gate 645. As the outputs of the counter 650 are cleared, a minimum value of the reference voltage $V_{REF1}$ can thus be obtained, which is determined by digital signals $N_1$ and $N_0$. When the soft-start signal MOD is disabled (logic-low), the counter 650 will start to count upward in response to the pulse signal PLS. This enables the reference voltage $V_{REF1}$ to be gradually increased. The upward counting will stop when each output of the counter 650 becomes logic-high. Therefore, the soft-start circuit 602 will modulate the switching signal $V_{PWM}$ in response to the reference voltage $V_{REF1}$. The duty cycle of the switching signal $V_{PWM}$ will be varied in a soft-start manner when the feedback signal $V_{FB}$ changes from the second feedback level to the first feedback level.

Figure 5:
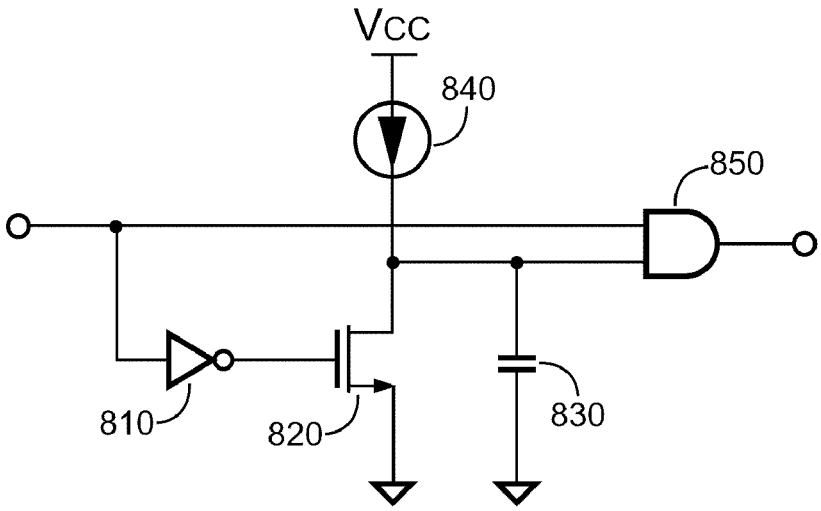
FIG. 5 shows an embodiment of a delay circuit of the dimming arbiter according to the present invention.

FIG. 5 shows an embodiment of a delay circuit, such as the delay circuits 615 and 625, according to the present invention. The delay circuit comprises a current source 840, an inverter 810, a transistor 820, a capacitor 830 and an AND gate 850. An input terminal of the delay circuit is connected to an input terminal of the inverter 810 and a first input terminal of the AND gate 850. An output terminal of the inverter 810 is connected to a gate of the transistor 820. A drain of the transistor 820 is connected to a second input terminal of the AND gate 850. The current source 840 is connected between the voltage source $V_{CC}$ and the drain of the transistor 820. A source of the transistor 820 is connected to the primary ground reference. The capacitor 830 is connected between the drain of the transistor 820 and the primary ground reference. An output terminal of the AND gate 850 is connected to an output terminal of the delay circuit for generating a delayed signal. Therefore, the delay circuit receives an input signal to generate the delayed signal after a delay time. The delay time of the delay circuit is determined by the current magnitude of the current source 840 and the capacitance of the capacitor 830.

Figure 6:
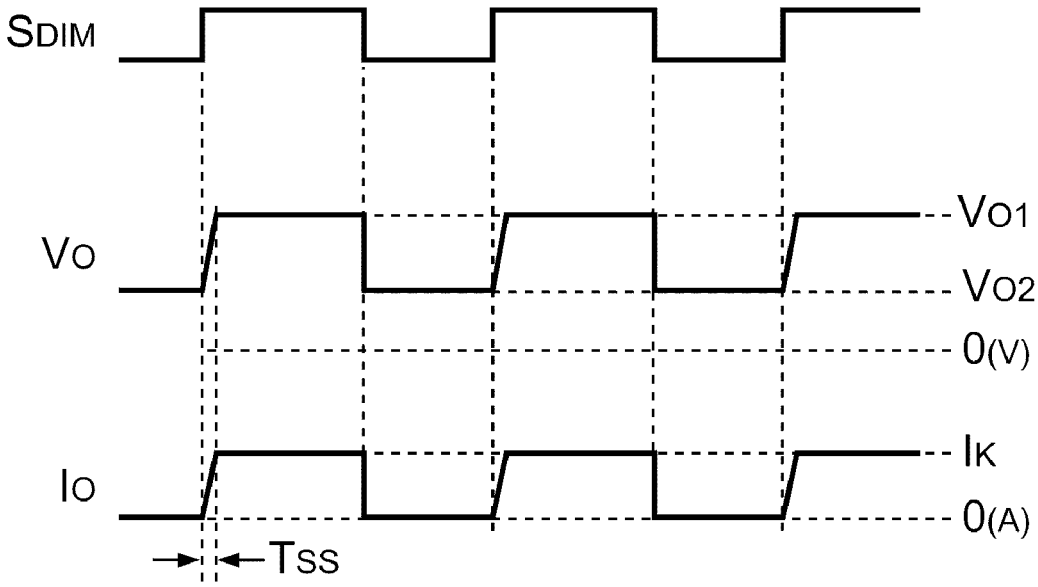
FIG. 6 shows key waveforms of the present invention.

FIG. 6 shows key waveforms of the present invention. Referring to FIG. 1 and FIG. 6, when the dimming signal $S_{DIM}$ becomes logic-low, the transistor 37 will be turned off to modulate the feedback signal $V_{FB}$ at the second feedback level. The output voltage $V_O$ will be regulated at a second output level $V_{O2}$ in accordance with the second feedback level of the feedback signal $V_{FB}$. The second output level $V_{O2}$ of the output voltage $V_O$ is a predetermined level that is just lower than a summed forward voltage of series connected LEDs 27~29. As the second output level $V_{O2}$ of the output voltage $V_O$ is generated at the output terminal of the offline LED driving circuit 100*a*, the LEDs 27~29 are all off. It can be expressed by following equation:

$$V_{O2} = \frac{R_{32} + R_{33}}{R_{33}} \times V_r \tag{2}$$

where $R_{32}$ and $R_{33}$ represents the resistance of resistors 32 and 33; $V_r$ represents the value of the reference voltage $V_R$.

When the dimming signal $S_{DIM}$ becomes logic-high, the transistor 37 will be turned on to connect the resistor 34 and the resistor 33 in parallel. This modulates the feedback signal $V_{FB}$ at the first feedback level. The output voltage $V_O$ will be regulated at a first output level $V_{O1}$ in accordance with the first feedback level of the feedback signal $V_{FB}$. The first output level $V_{O1}$ of the output voltage $V_O$ is a predetermined level that is just higher than a summed forward voltage of series connected LEDs 27~29. As the first output level $V_{O1}$ of the output voltage $V_O$ is generated at the output terminal of the offline LED driving circuit 100*a*, the LEDs 27~29 are all on. It can be expressed by following equation:

$$V_{O1} = \frac{R_{32} + R_P}{R_P} \times V_r \tag{3}$$

where $R_P$ represents a parallel equivalent resistance of the resistors 33 and 34, which can be expressed by following equation:

$$R_P = \frac{R_{33} \times R_{34}}{R_{33} + R_{34}} \tag{4}$$

The first feedback level is greater than the second feedback level and the first output level $V_{O1}$ is greater than the second output level $V_{O2}$. The output voltage $V_O$ is alternately regulated between the first output level $V_{O1}$ and the second output level $V_{O2}$ in response to the dimming signal $S_{DIM}$. The output current $I_O$ is also alternately regulated between zero and a constant current level $I_K$ in response to the dimming signal $S_{DIM}$. A period that the output voltage $V_O$ ramps up from the second output level $V_{O2}$ to the first output level $V_{O1}$ equals to a period that the output current $I_O$ ramps up from zero to the constant current level $I_K$. In response to the control signal $V_F$, the dimming arbiter 600 results in an increment of the output current $I_O$ in a soft-start manner during the aforementioned period, which is denoted $T_{SS}$ in FIG. 6.

Figure 7:
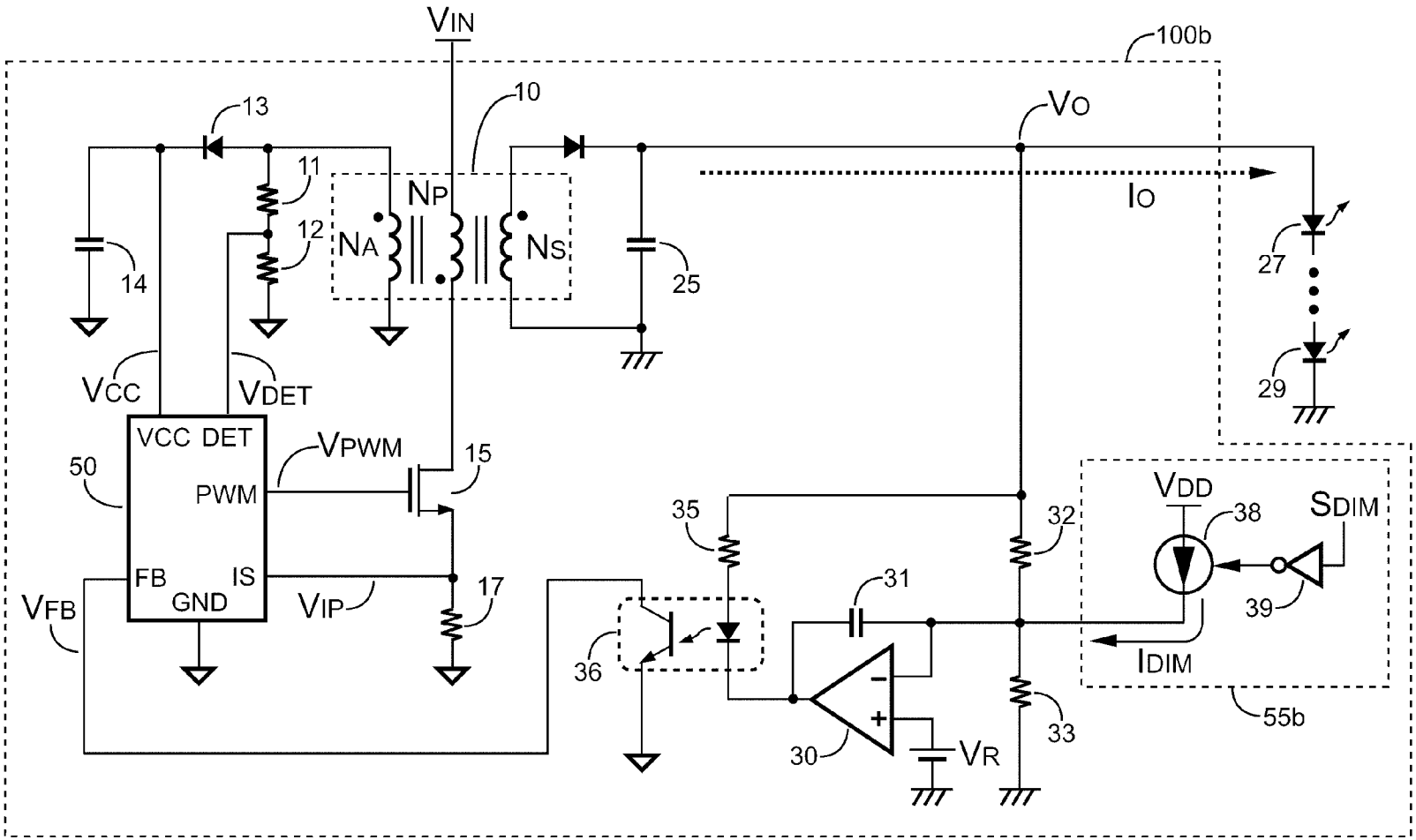
FIG. 7 shows another embodiment of the offline LED driving circuit according to the present invention.

FIG. 7 shows another embodiment of the offline LED driving circuit 100*b* according to the present invention. Different to the embodiment shown in FIG. 1, a dimming circuit 55*b* comprises a current source 38 and an inverter 39. The dimming signal $S_{DIM}$ controls the current source 38 via the inverter 39. A current $I_{DIM}$ is supplied by the current source 38 to the joint of resistors 32 and 33. The dimming circuit 55*b* is connected to the shunt regulator to modulate the feedback signal $V_{FB}$. The first output level $V_{O1}$ and the second output level $V_{O2}$ of the output voltage $V_O$ can be respectively expressed as following equations:

$$V_{O1} = \frac{R_{32} + R_{33}}{R_{33}} \times V_r \tag{5}$$

$$V_{O2} = \left[\left(\frac{R_{32} + R_{33}}{R_{33}} \times V_r\right) - (I_{DIM} \times R_{32})\right] \tag{6}$$

As the embodiments described above, the offline LED driving circuit of the present invention utilizes a PWM modulated dimming signal to alternately regulate the output voltage $V_O$ between two output levels and alternately regulate the output current $I_O$ between zero and a constant current level $I_K$ for achieve LED dimming control with stable color temperature performance.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An offline LED driving circuit, comprising:

a controller, generating a switching signal to switch a transformer for providing an output voltage and an output current at an output terminal of said offline LED driving circuit;

a shunt regulator, coupled to said output terminal of said offline LED driving circuit for providing a feedback signal to said controller; and a dimming circuit, coupled to said shunt regulator to modulate said feedback signal;

wherein said dimming circuit respectively modulates said feedback signal at a first feedback level and a second feedback level in response to a dimming signal; and wherein a duty cycle of said switching signal is varied in response to said feedback signal, said output voltage is respectively regulated at a first output level and a second output level in response to said first feedback level and said second feedback level of said feedback signal.

2. The offline LED driving circuit as claimed in claim 1, wherein said first feedback level is higher than said second feedback level.

3. The offline LED driving circuit as claimed in claim 1, wherein said controller comprises a soft-start circuit to vary said duty cycle of said switching signal in response to said feedback signal, and said duty cycle of said switching signal will be varied in a soft-start manner when said feedback signal changes from said second feedback level to said first feedback level.

4. The offline LED driving circuit as claimed in claim 1, further comprising an opto-coupler coupled between said shunt regulator and said controller.

5. The offline LED driving circuit as claimed in claim 1, wherein said controller comprises a latch circuit to latch an output state of said latch circuit when said feedback signal changes from said first feedback level to said second feedback level.

6. The offline LED driving circuit as claimed in claim 1, wherein said output voltage is alternately regulated between said first output level and said second output level in response to said dimming signal.

7. The offline LED driving circuit as claimed in claim 1, wherein said output current is alternately regulated between zero and a constant current level in response to said dimming signal.

8. The offline LED driving circuit as claimed in claim 1, wherein said first output level of said output voltage is determined to be higher than a summed forward voltage of series connected LEDs driven by said offline LED driving circuit.

9. The offline LED driving circuit as claimed in claim 1, wherein said second output level of said output voltage is determined to be lower than a summed forward voltage of series connected LEDs driven by said offline LED driving circuit.

* * * * *